US010104466B2

(12) United States Patent
Li et al.

(10) Patent No.: US 10,104,466 B2
(45) Date of Patent: Oct. 16, 2018

(54) SPEAKER DEVICE

(71) Applicant: GOERTEK INC., WeiFang, Shandong (CN)

(72) Inventors: Shugang Li, WeiFang (CN); Xiaodong Cai, WeiFang (CN); Cheng Zhang, WeiFang (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 15/568,180

(22) PCT Filed: Nov. 16, 2015

(86) PCT No.: PCT/CN2015/094674
§ 371 (c)(1),
(2) Date: Oct. 20, 2017

(87) PCT Pub. No.: WO2016/169256
PCT Pub. Date: Oct. 27, 2016

(65) Prior Publication Data

US 2018/0124499 A1 May 3, 2018

(30) Foreign Application Priority Data

Apr. 22, 2015 (CN) ..... 2015 1 0194261

(51) Int. Cl.
*H04R 25/00* (2006.01)
*H04R 1/24* (2006.01)
(Continued)

(52) U.S. Cl.
CPC ..... *H04R 1/24* (2013.01); *H04R 9/02* (2013.01); *H04R 9/025* (2013.01); *H04R 9/046* (2013.01);
(Continued)

(58) Field of Classification Search
None
See application file for complete search history.

(56) References Cited

U.S. PATENT DOCUMENTS

2010/0290650 A1* 11/2010 Ogura ..... H01Q 1/44 381/190
2011/0274309 A1* 11/2011 Doh ..... H04R 9/047 381/398

FOREIGN PATENT DOCUMENTS

CN 2165591 Y 5/1994
CN 104822112 A 8/2015
(Continued)

OTHER PUBLICATIONS

International Search Report and Written Opinion, dated Feb. 23, 2016, State Intellectual Property Office of the P.R. China.

*Primary Examiner* — James Mooney
(74) *Attorney, Agent, or Firm* — Holzer Patel Drennan

(57) ABSTRACT

Disclosed is a speaker device, comprising a vibration system, a magnetic circuit system, and an auxiliary system fixedly accommodating the magnetic circuit system and the vibration system. The vibration system comprises a center suspension comprising a first fixing portion, a second fixing portion within the first fixing portion, and a connecting arm connecting the first fixing portion and the second fixing portion. A central position of the second fixing portion is provided with a piezoelectric piece, the center suspension is provided with a first pad corresponding to the piezoelectric piece, and the piezoelectric piece is electrically connected to the first pad. The second fixing portion is provided with an antenna circuit. In the speaker device of the present invention, the signal emitted by the piezoelectric piece effectively increases the medium and high frequency effect and enhances the acoustic performance. The antenna circuit integrates the antenna device and the speaker device.

9 Claims, 3 Drawing Sheets

(51) Int. Cl.

| | |
|---|---|
| ***H04R 9/02*** | (2006.01) |
| ***H04R 9/06*** | (2006.01) |
| ***H04R 17/00*** | (2006.01) |
| ***H04R 9/04*** | (2006.01) |
| ***H04R 23/02*** | (2006.01) |

(52) U.S. Cl.
CPC ..... *H04R 9/06* (2013.01); *H04R 17/00* (2013.01); *H04R 23/02* (2013.01); *H04R 2209/024* (2013.01); *H04R 2420/07* (2013.01)

(56) References Cited

FOREIGN PATENT DOCUMENTS

| | | | |
|---|---|---|---|
| CN | 204616080 | U | 9/2015 |
| WO | 9914980 | A2 | 3/1999 |

* cited by examiner

SPEAKER DEVICE

TECHNICAL FIELD

The present invention relates to the field of electro-acoustic, and more particularly to a speaker device having an excellent acoustic performance and a high degree of integration.

BACKGROUND

With the development of science and technology, portable electronic devices have drawn an extensive attention. A speaker device, which is a main sound unit of a portable electronic terminal, directly affects the user experience on the portable electronic device.

The speaker device in prior art comprises a vibration system, a magnetic circuit system and an auxiliary system. The auxiliary system accommodates and fixes the vibration system and the magnetic circuit system. The vibration system comprises a voice coil, a diaphragm and a center suspension. The central position of the center suspension is provided with a reinforcing part. The magnetic circuit system comprises a magnet and a magnetically conductive component. The magnetic circuit system is provided with a magnetic gap, and the voice coil is provided in the magnetic gap. The voice coil is applied with Lorentz force due to varied current of the conductive voice coil in the magnetic field and then vibrate, such that the diaphragm is drove to vibrate so as to emit a sound. In the speaker device of such structure, the frequency-response curve in high frequency thereof will rapidly descend in several dozens of KHz, which results in cutoff frequency in high frequency, and thus can not produce sound waves with a higher frequency and a better acoustic quality. Due to the limitations on materials and processes of traditional speaker devices, the cutoff frequency in high frequency thereof is difficult to be improved, and thus the medium and high frequency effect of the speaker device is also difficult to be significantly improved.

As portable electronic devices are becoming thinner and thinner, the integrated design of their internal electronic components becomes a design trend, and thus traditional speaker devices with single function cannot meet the requirements on novel portable electronic devices any longer.

Accordingly, it is necessary to propose an improved speaker device to overcome the drawbacks of the speaker device in prior art.

SUMMARY

The technical problem sought to be solved by the present invention is to provide a speaker device having an excellent acoustic performance and a high degree of integration.

In order to achieve the above objective, the present invention adopts the following technical solution:

A speaker device comprises a vibration system, a magnetic circuit system, and an auxiliary system accommodating and fixing the magnetic circuit system and the vibration system. The vibration system comprises a diaphragm, a center suspension and a voice coil which are combined together. The center suspension comprises a first fixing portion, a second fixing portion arranged within the first fixing portion, and a connecting arm connecting the first fixing portion and the second fixing portion, and a central position of the second fixing portion is provided with a piezoelectric piece, the center suspension is provided with a first pad corresponding to the piezoelectric piece, and the piezoelectric piece is electrically connected to the first pad, and the second fixing portion is provided with an antenna circuit.

As a preferred embodiment, the first fixing portion is provided with a first external pad corresponding to the first pad, and the first external pad is electrically connected to the first pad.

As a further preferred embodiment, the second fixing portion is provided with a second pad corresponding to the voice coil, and the second pad is electrically connected to the voice coil.

As a still further preferred embodiment, the first fixing portion is provided with a second external pad corresponding to the second pad, and the second external pad is electrically connected to the second pad.

As a further preferred embodiment, the first fixing portion is provided with a third external pad, and the third external pad is electrically connected to the antenna circuit.

As a further preferred embodiment, the first fixing portion is provided with an extension portion, and one of the first external pad, the second external pad, and the third external pad is provided on the extension portion.

As a preferred embodiment, the antenna circuit is provided at one side of the second fixing portion close to the diaphragm.

As a further preferred embodiment, the piezoelectric piece is provided at one side of the second fixing portion away from the diaphragm.

As a further preferred embodiment, the center suspension is provided with a conductive circuit, and each of the first fixing portion, the second fixing portion, and the connecting arm position is provided with the conductive circuit.

As a preferred embodiment, the antenna circuit is provided in the second fixing portion by laser direct structuring.

In the speaker device of the present invention, the piezoelectric piece is used for replacing a reinforcing part provided at the central position of the center suspension of a conventional speaker device, and the piezoelectric piece may act as the reinforcing part to improve the acoustic performance of the speaker device. At the same time, the piezoelectric piece acts as a separate sound unit, and can emit medium and high frequency of audio signal to complement the audio signal of the sound structure composed of the voice coil and the diaphragm. The signal emitted from the piezoelectric piece is mixed with the audio signal emitted from the voice coil-diaphragm, which effectively improves the medium and high frequency effect of the speaker device and improves the acoustic performance of the speaker device. In the speaker device of the present invention, the antenna circuit is provided at a central position of the second fixing portion of the center suspension, and integrally combines the antenna device with the sound device, which implements the function of the antenna and facilitates the thickness-reduced design and the integrated design of the product with not increasing the thickness of the speaker device and facilitating the thickness-reduced design of the speaker device.

Thus, the speaker device of the present invention has the advantages of an excellent acoustic performance and a high degree of integration.

DETAILED DESCRIPTION

The present invention will be described in detail with reference to the accompanying drawings.

Figure 1:
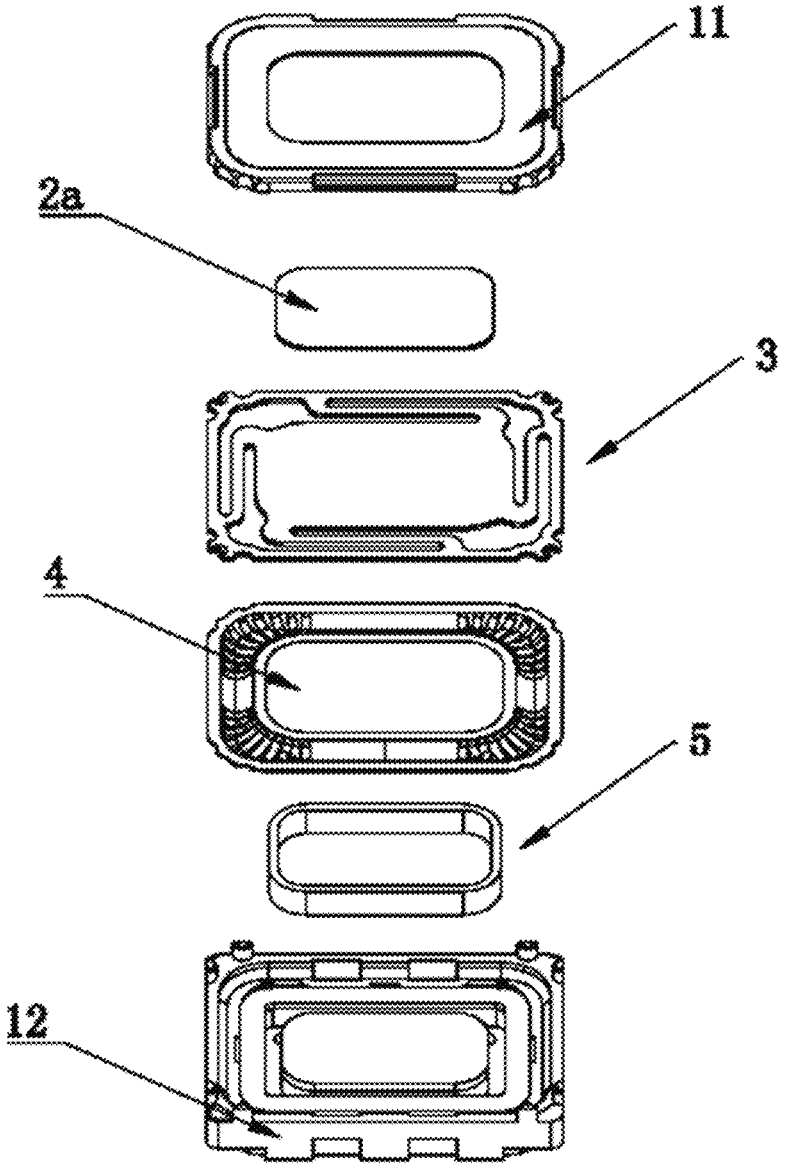
FIG. 1 is an exploded view of a particular embodiment of the speaker device of the present invention.
Figure 2:
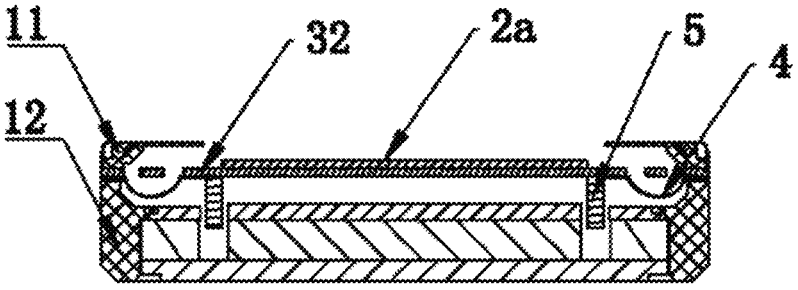
FIG. 2 is a cross-sectional view of the speaker device shown in FIG. 1.

As shown in FIGS. 1 and 2, a particular embodiment of the speaker device of the present invention comprises a vibration system, a magnetic circuit system and an auxiliary system. The auxiliary system comprises a front cover 11 and a housing 12, and the vibration system and the magnetic circuit system are accommodated and fixed by the front cover 11 and the housing 12. The vibration system comprises a diaphragm 4, a center suspension 3 and a voice coil 5 which are fixedly combined with the diaphragm 4. The magnetic circuit system comprises a magnet and a magnetically conductive component. As shown in FIG. 2, the magnetic circuit system is provided with a magnetic gap, and the voice coil 5 is suspended in the magnetic gap. When an external electric signal enters the voice coil 5, the current in the voice coil 5 provided in the magnetic field changes, so that the voice coil 5 is applied with the Lorentz force so as to vibrate up and down. The vibrated voice coil 5 drives the diaphragm 4 to vibrate, and thus the vibration of the diaphragm 4 drives the air to emit a sound.

Figure 3:
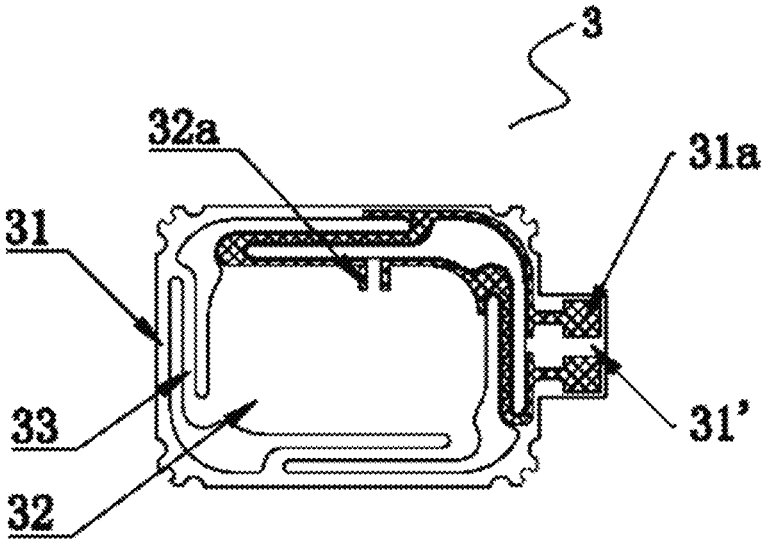
FIG. 3 is a schematic view of one side of the center suspension shown in FIG. 1.
Figure 4:
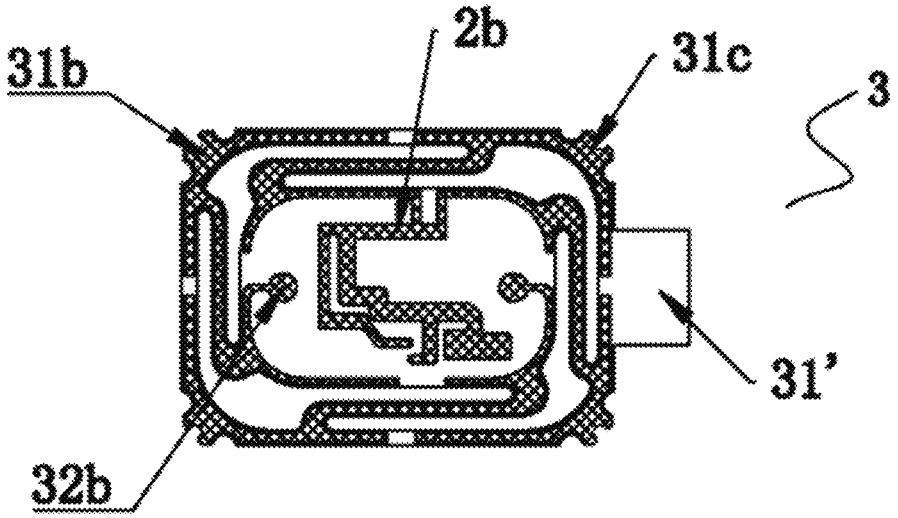
FIG. 4 is a schematic view of the other side of the center suspension shown in FIG. 3.

As shown in FIG. 3, in the speaker device of the present invention, the center suspension 3 comprises a first fixing portion 31, a second fixing portion 32 arranged in the first fixing portion 31. The first fixing portion 31 and the second fixing portion 32 are connected by connecting arms 33. As shown in FIGS. 1 and 2, a piezoelectric piece 2*a* is provided at the center of the second fixing portion 32 of the center suspension 3. In the piezoelectric speaker of the present invention, the piezoelectric piece 2*a* acts as another sound source, and cooperates with the sound source composed of the voice coil and the diaphragm. The piezoelectric piece 2*a* emits a sound with an excellent high frequency effect, which complements the audio signal generated by the sound structure composed of the voice coil and the diaphragm. The signal emitted from the piezoelectric piece 2*a* is mixed with the audio signal emitted from the voice coil-diaphragm structure, which effectively improves the medium and high frequency effect of the speaker device and improves the acoustic performance of the speaker device. As shown in FIG. 4, the second fixing portion 32 of the speaker device of the present invention is provided with an antenna circuit 2*b*, so that the speaker device of the present invention has an antenna function. The antenna circuit provided on the second fixing portion of the center suspension does not occupy the space of the speaker device, which is advantageous for the thickness-reduced design of the speaker device. The antenna circuit enables the speaker device of the present invention to have a signal transmitting and receiving function and is advantageous for the integrated design of the speaker device. At the same time, as the antenna circuit is provided on the center suspension of the speaker and located inside the speaker, and the antenna circuit can be protected, the antenna circuit provided outside the speaker device is prevented from being damaged in the production and application processes of the speaker, thereby improving the reliability of the antenna circuit.

As shown in FIG. 3, the second fixing portion 32 of the center suspension 3 is provided with a set of first pads 32*a*, and the first pads 32*a* are electrically connected to the piezoelectric piece. The first fixing portion 31 is provided with a set of first external pads 31*a* corresponding to the first pads 32*a*, and the first external pads 31*a* are electrically connected to the first pads 32*a*.

As shown in FIG. 4, the second fixing portion 32 of the center suspension 3 is provided with a set of second pads 32*b*. The second pads 32*b* are arranged in correspondence with the voice coil, and are connected to a voice coil leading wire by welding. The first fixing portion 31 is provided with a set of second external pads 31*b* corresponding to the second pads 32*b*, and the second external pads 31*b* are electrically connected to the second pads 32*b*. As shown in FIG. 4, the first fixing portion 31 is provided with a set of third external pads 31*c*, which are electrically connected to the antenna circuit 2*b*.

As shown in FIGS. 3 and 4, the first fixing portion 31 of the center suspension 3 of the speaker device of the present invention is provided with an extension portion 31'. In the center suspension 3 of the present embodiment, the extension portion 31' is provided with first external pads 31*a*. In the practical application, the second external pads 31*b* or the third external pads 31*c* may be provided on the extension portion 31', both of which don't affect the advantages of the speaker device of the present invention. The external pads on the extension portion 31' can simplify the circuit design of the speaker device of the present invention and reduce the production difficulty of the speaker device. As shown in FIGS. 3 and 4, in the speaker device of the present invention, the center suspension is of a square structure. The remaining two sets of external pads are respectively provided at four corners of the first fixing portion 31 of the center suspension of the square structure. The three sets of external pads do not interfere with each other, which is conducive to lead out the pads so as to be combined with external circuits.

As shown in FIG. 4, in the speaker device of the present embodiment, the antenna circuit 2*b* is provided at one side of the second fixing portion 32 close to the diaphragm (at the same side with the second pads 32*b*, the second pads 32*b* is connected to the voice coil by welding and is disposed at one side close to the voice coil, i.e., one side close to the diaphragm). As shown in FIG. 2, the piezoelectric piece 2*a* is provided at one side of the second fixing portion 32 away from the diaphragm. Since the speaker device is designed in such a way, the circuits on the center suspension 3 do not interfere with each other, which simplifies the design of the circuit on the center suspension 3, reduces the design difficulty of the center suspension 3, and simplifies the production difficulty of the speaker device.

As shown in FIGS. 3 and 4, the center suspension of the present embodiment is provided with a conductive circuit, which may be a flexible conductive circuit board. Each of the first fixing portion 31, the second fixing portion 32, and connecting arms 33 are provided with the conductive circuit to ensure that the piezoelectric piece, the antenna circuit, and the voice coil are electrically connected to the external circuit.

In the practical application, the antenna circuit may be provided on the second fixing portion by laser direct structuring (LDS) to reduce the circuit design of the second fixing portion per se, and simplify the design difficulty and production difficulty of the second fixing portion.

In the speaker device of the present invention, the piezoelectric piece acts as a separate sound unit, and can emit medium and high frequency audio signal to complement the audio signal of the sound structure composed of the voice coil and the diaphragm. The signal emitted from the piezoelectric piece is mixed with the audio signal emitted from the voice coil-diaphragm, which effectively improves the medium and high frequency effect of the speaker device and improves the acoustic performance of the speaker device. The antenna circuit is provided at a central position of the second fixing portion of the center suspension and integrally combines the antenna device with the sound device, which implements the function of the antenna and facilitates the thickness-reduced design and the integrated design of the product with not increasing the thickness of the speaker device and facilitating the thickness-reduced design of the speaker device. Thus, the speaker device of the present invention has the advantages of an excellent acoustic performance, a high degree of integration and multiple functionalities.

The above-mentioned are only embodiments of the present invention and are not for limiting the present invention, thus the equivalent modification or variation made by those skilled in the art according to the present invention should be incorporated into the protection scope recited in the claims.

What is claimed is:

1. A speaker device, comprising a vibration system, a magnetic circuit system, and an auxiliary system accommodating and fixing the magnetic circuit system and the vibration system, wherein the vibration system comprises a diaphragm, a center suspension and a voice coil which are combined together, the center suspension comprises a first fixing portion, a second fixing portion arranged within the first fixing portion, and a connecting arm connecting the first fixing portion and the second fixing portion, and wherein a central position of the second fixing portion is provided with a piezoelectric piece, the center suspension is provided with a first pad corresponding to the piezoelectric piece, and the piezoelectric piece is electrically connected to the first pad, and the second fixing portion is provided with an antenna circuit, and the antenna circuit is provided on the second fixing portion by laser direct structuring.

2. The speaker device according to claim 1, wherein the first fixing portion is provided with a first external pad corresponding to the first pad, and the first external pad is electrically connected to the first pad.

3. The speaker device according to claim 2, wherein the second fixing portion is provided with a second pad corresponding to the voice coil, and the second pad is electrically connected to the voice coil.

4. The speaker device according to claim 3, wherein the first fixing portion is provided with a second external pad corresponding to the second pad, and the second external pad is electrically connected to the second pad.

5. The speaker device according to claim 4, wherein the first fixing portion is provided with a third external pad, and the third external pad is electrically connected to the antenna circuit.

6. The speaker device according to claim 5, wherein the first fixing portion is provided with an extension portion, and one of the first external pad, the second external pad, and the third external pad is provided on the extension portion.

7. The speaker device according to claim 5, wherein the center suspension is provided with a conductive circuit, and each of the first fixing portion, the second fixing portion, and the connecting arm is provided with the conductive circuit.

8. The speaker device according to claim 1, wherein the antenna circuit is provided at one side of the second fixing portion towards the diaphragm.

9. The speaker device according to claim 8, wherein the piezoelectric piece is provided at an opposite side of the second fixing portion away from the diaphragm.

* * * * *